US010636347B2

(12) United States Patent
Kim et al.

(10) Patent No.: US 10,636,347 B2
(45) **Date of Patent: *Apr. 28, 2020**

(54) TWO ROWS DRIVING METHOD FOR MICRO DISPLAY DEVICE

(71) Applicant: Kopin Corporation, Westborough, MA (US)

(72) Inventors: Jin Kuk Kim, San Jose, CA (US); Yong Seok Seo, Palo Alto, CA (US); Seung Youb Kim, Fremont, CA (US); Jang Ho Kim, San Jose, CA (US); Frederick Herrmann, Westborough, MA (US)

(73) Assignee: Kopin Corporation, Westborough, MA (US)

( * ) Notice: Subject to any disclaimer, the term of this patent is extended or adjusted under 35 U.S.C. 154(b) by 52 days.

This patent is subject to a terminal disclaimer.

(21) Appl. No.: 16/382,960

(22) Filed: Apr. 12, 2019

(65) Prior Publication Data

US 2019/0237002 A1 Aug. 1, 2019

Related U.S. Application Data

(63) Continuation of application No. 15/294,931, filed on Oct. 17, 2016, now Pat. No. 10,304,372.

(Continued)

(51) Int. Cl.

| | |
|---|---|
| ***G09G 3/3291*** | (2016.01) |
| ***G09G 3/20*** | (2006.01) |
| ***G09G 3/36*** | (2006.01) |

(52) U.S. Cl.

CPC ..... *G09G 3/2092* (2013.01); *G09G 3/2007* (2013.01); *G09G 3/3291* (2013.01);

(Continued)

(58) Field of Classification Search

CPC .. G09G 3/2007; G09G 3/3291; G09G 3/3688; G09G 3/2092; G09G 2310/0291;

(Continued)

(56) References Cited

U.S. PATENT DOCUMENTS 10,304,372 B2 * 5/2019 Kim ..... G09G 3/2092
2008/0252767 A1 * 10/2008 Muramatsu ..... H03M 1/1023 348/312

(Continued)

FOREIGN PATENT DOCUMENTS

| | | |
|---|---|---|
| JP | 2012088536 | 5/2012 |
| WO | 2004017288 | 2/2004 |
| WO | 2017070047 | 4/2017 |

OTHER PUBLICATIONS

International Search Report and Written Opinion of PCT/US2016/057333 dated Dec. 16, 2016 entitled "Two Rows Driving Method for Micro Display Device.".

(Continued)

*Primary Examiner* — Carolyn R Edwards

(74) *Attorney, Agent, or Firm* — Hamilton, Brook, Smith & Reynolds, P.C.

(57) ABSTRACT

A method of driving a pixel array includes providing a ramp signal to one or more columns of the pixel array. For each cycle of the ramp signal, the method further includes providing a first row driving signal to at least a first row of the pixel array and a second row driving signal to a second row of the pixel array. A pixel array driver may include a ramp signal generator configured to produce a ramp signal, a first amplifier configured to receive the ramp signal and produce a first amplified ramp signal, and a second amplifier configured to receive the ramp signal and produce a second amplified ramp signal. The first amplified ramp signal may be electrically connected to a first set of pixels of a pixel (Continued)

array, and the second amplified ramp signal may be electrically connected to a second set of pixels of the pixel array.

20 Claims, 7 Drawing Sheets

Related U.S. Application Data

(60) Provisional application No. 62/247,327, filed on Oct. 28, 2015, provisional application No. 62/243,411, filed on Oct. 19, 2015.

(52) U.S. Cl.
CPC ... *G09G 3/3688* (2013.01); *G09G 2300/0426* (2013.01); *G09G 2310/0205* (2013.01); *G09G 2310/027* (2013.01); *G09G 2310/0221* (2013.01); *G09G 2310/0259* (2013.01); *G09G 2310/0291* (2013.01)

(58) Field of Classification Search
CPC ..... G09G 2310/027; G09G 2310/0259; G09G 2310/0221; G09G 2310/0205; G09G 2300/0426
See application file for complete search history.

(56) References Cited

U.S. PATENT DOCUMENTS

| | | | | |
|---|---|---|---|---|
| 2011/0080391 | A1* | 4/2011 | Brown | G06F 3/0412 345/207 |
| 2013/0214127 | A1* | 8/2013 | Ohya | H04N 5/378 250/208.1 |
| 2015/0221277 | A1* | 8/2015 | Seo | G09G 3/3696 345/690 |

OTHER PUBLICATIONS

International Preliminary Report on Patentability for PCT/US2016/057333 dated Apr. 24, 2018 entitled"Two Rows Driving Method for Micro Display Device.".

* cited by examiner

TWO ROWS DRIVING METHOD FOR MICRO DISPLAY DEVICE

RELATED APPLICATIONS

This application is a continuation of U.S. application Ser. No. 15/294,931, filed Oct. 17, 2016, which claims priority to U.S. Provisional Application No. 62/243,411, filed on Oct. 19, 2015 and U.S. Provisional Application No. 62/247,327 filed Oct. 28, 2015. The entire teachings of the above applications are incorporated herein by reference.

BACKGROUND OF THE INVENTION

Mobile computing devices, such as notebook PCs, smart phones, and tablet computing devices, are now common tools used for producing, analyzing, communicating, and consuming data in both business and personal life. Consumers continue to embrace a mobile digital lifestyle as the ease of access to digital information increases with high-speed wireless communications technologies becoming ubiquitous. Popular uses of mobile computing devices include displaying large amounts of high-resolution computer graphics information and video content, often wirelessly streamed to the device.

While these devices typically include a display screen, the preferred visual experience of a high-resolution, large format display cannot be easily replicated in such mobile devices because the physical size of such device is limited to promote mobility. Another drawback of the aforementioned device types is that the user interface is hands-dependent, typically requiring a user to enter data or make selections using a keyboard (physical or virtual) or touch-screen display.

As a result, consumers now seek a hands-free, high-quality, portable, color display solution to augment or replace their hands-dependent mobile devices. Such display solutions have practical size and weight limitations, which consequently limit available power resources (e.g., battery size). Given limited power resources, reducing the power consumption of the display increases the amount of time the display can operate on a single charge of the associated power resource.

For some types of display devices, operation requires a periodic ramp signal to be provided to pixel columns of the array. While the power requirements of a ramp signal generator may be dependent on many factors, often two major contributors are (i) the number of pixels in the display, and (ii) the frequency of the ramp signal. So for a display of a fixed size, the power requirements of the ramp signal generator, and consequently the associated display device, rely heavily on the ramp frequency.

State of the art display applications are driving a need for higher ramp signal frequencies, which, as described above, drive higher power requirements.

SUMMARY OF THE INVENTION

Recently developed micro-displays can provide large-format, high-resolution color pictures and streaming video in a very small form factor. One application for such displays can be integrated into a wireless headset computer worn on the head of the user with a display within the field of view of the user, similar in format to eyeglasses, audio headset or video eyewear.

A "wireless computing headset" device, also referred to herein as a headset computer (HSC) or head mounted display (HMD), includes one or more small, high resolution micro-displays and associated optics to magnify the image. The high resolution micro-displays can provide super video graphics array (SVGA) (800×600) resolution or extended graphic arrays (XGA) (1024×768) resolution, or higher resolutions known in the art.

A wireless computing headset contains one or more wireless computing and communication interfaces, enabling data and streaming video capability, and provides greater convenience and mobility through hands dependent devices.

For more information concerning such devices, see co-pending patent applications entitled "Mobile Wireless Display Software Platform for Controlling Other Systems and Devices," U.S. application Ser. No. 12/348,646 filed Jan. 5, 2009; "Handheld Wireless Display Devices Having High Resolution Display Suitable For Use as a Mobile Internet Device," PCT International Application No. PCT/US09/38601 filed Mar. 27, 2009; and "Improved Headset Computer," U.S. Application No. 61/638,419 filed Apr. 25, 2012, each of which is incorporated herein by reference in its entirety.

As used herein "HSC" headset computers, "HMD" head mounded display device, and "wireless computing headset" device may be used interchangeably.

The embodiments described herein reduce power of a micro-display, for example one associated with a HSC, by one or more of (i) reducing the frequency of a ramp signal used to drive columns of a micro-display pixel array, and (ii) increasing the number of rows of the array driven for each cycle of the column-driving ramp signal.

In one aspect, the invention may be a method of driving a pixel array, comprising providing a ramp signal to one or more columns of the pixel array. For each cycle of the ramp signal, providing a first row driving signal to a first row of the pixel array and a second row driving signal to a second row of the pixel array.

One embodiment further includes providing a first amplifier and a second amplifier. Each of the first and second amplifiers receives an input ramp signal from a digital-to-analog converter and produces a first amplified ramp signal and a second amplified ramp signal, respectively. The first amplifier and the second amplifier may be unity gain amplifiers (i.e., gain equal to one (1)), although the gain of the amplifiers may be fractional (i.e., between zero (0) and one (1)) or greater than one (1).

Another embodiment may further include coupling an output of the first amplifier to a first set of pixels of a pixel array and coupling an output of the second amplifier to a second set of pixels of the pixel array. The first set of pixels of the pixel array may be a first set of pixel columns, and the second set of pixels of the pixel array may be a second set of pixel columns. The first set of pixel columns and the second set of pixel columns may be spatially arranged on the pixel array (or on the substrate or other foundation that hosts the pixel array) such that columns of the first set of pixel columns alternate with columns of the second set of pixel columns.

One embodiment may further include providing the first amplified ramp signal to the first set of pixels of the pixel array and providing the second amplified ramp signal to the second set of pixels of the pixel array.

One embodiment further includes coupling an output of the first amplifier to a first set of pixels of a pixel array and coupling an output of the second amplifier to a second set of pixels of the pixel array. The first set of pixels of the pixel array may be a first set of pixel rows (from a total of N rows of pixels in the pixel array), the second set of pixels of the pixel array being a second set of pixel rows (from the total N rows of the pixel array). The first set of pixel rows including pixels of rows 1 through M, and the second set of pixels including pixels of rows M+1 through N, where M and N are integers.

One embodiment further includes providing the first amplified ramp signal to the first set of pixel rows, and providing the second amplified ramp signal to the second set of pixel rows.

Another embodiment further includes coupling an output of the first amplifier to a first set of pixels of a pixel array and coupling an output of the second amplifier to a second set of pixels of the pixel array. the first set of pixels of the pixel array being a first set of pixel rows, the second set of pixels of the pixel array being a second set of pixel rows, the first set of pixel rows and the second set of pixel rows being spatially arranged on the pixel array such that rows of the first set of pixel rows alternate with rows of the second set of pixel rows.

An embodiment includes providing a digital-to-analog converter configured to generate the ramp signal.

In another aspect, the invention may be a pixel array driver, comprising a ramp signal generator configured to produce a ramp signal, a first amplifier configured to receive the ramp signal and produce a first amplified ramp signal, and a second amplifier configured to receive the ramp signal and produce a second amplified ramp signal. The first amplified ramp signal may be electrically connected to a first set of pixels of a pixel array, and the second amplified ramp signal may be electrically connected to a second set of pixels of the pixel array.

In one embodiment, the first set of pixels of the pixel array is a first set of pixel columns, and the second set pixels of the pixel array is a second set of pixel columns. The first set of pixel columns and the second set of pixel columns may be spatially arranged (i.e., referring to the physical layout of the pixels) on the pixel array such that columns of the first set of pixel columns alternate with columns of the second set of pixel columns.

In another embodiment, the first set of pixel columns includes the $N^{th}$ pixel columns, and the second set of pixel columns includes the $(N+1)^{th}$ pixel columns, where N designates two or more consecutive even integers, beginning with N=2. It should be understood, for all embodiments described herein, that the total number of pixels (and therefore number of pixel columns) is finite, the total number being constrained by the size and shape of the associated display device.

In another embodiment, the first set of pixel columns receives the first amplified ramp signal, and the second set of pixel columns receives the second amplified ramp signal.

In one embodiment, the first set of pixels and the second set of pixels of the pixel array are arranged in N rows. The first set of pixels includes pixels of rows 1 through M, and the second set of pixels includes pixels of rows M+1 through N, where M and N are integers.

The pixel array driver of claim 14, wherein the pixels of rows 1 through M receive the first amplified ramp signal, and the pixels of rows M+1 through N receive the second amplified ramp signal.

In another embodiment, the first set of pixels of the pixel array is a first set of pixel rows, and the second set pixels of the pixel array is a second set of pixel rows. The first set of pixel rows and the second set of pixel rows may be spatially arranged on the pixel array such that rows of the first set of pixel rows alternate with rows of the second set of pixel rows. For example, the first set of pixel rows may include the first row, the third row, the fifth row, and so on, while the second set of pixel rows may include the second row, the fourth row, the sixth row, and so on. The pixels of the first set of pixel rows may receive the first amplified ramp signal, and the pixels of the second set of pixel rows may receive the second amplified ramp signal.

In another embodiment, the ramp signal generator includes a digital-to-analog converter. The ramp signal generator may further include a counter configured to generate a digital word and provide the digital word to the digital-to-analog converter, wherein the digital word counts from an initial value to a terminal value, rolls over to the initial value, and repeats the count from the initial value.

In another embodiment, the first and second amplifiers are unity gain amplifiers. In other embodiments, the

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
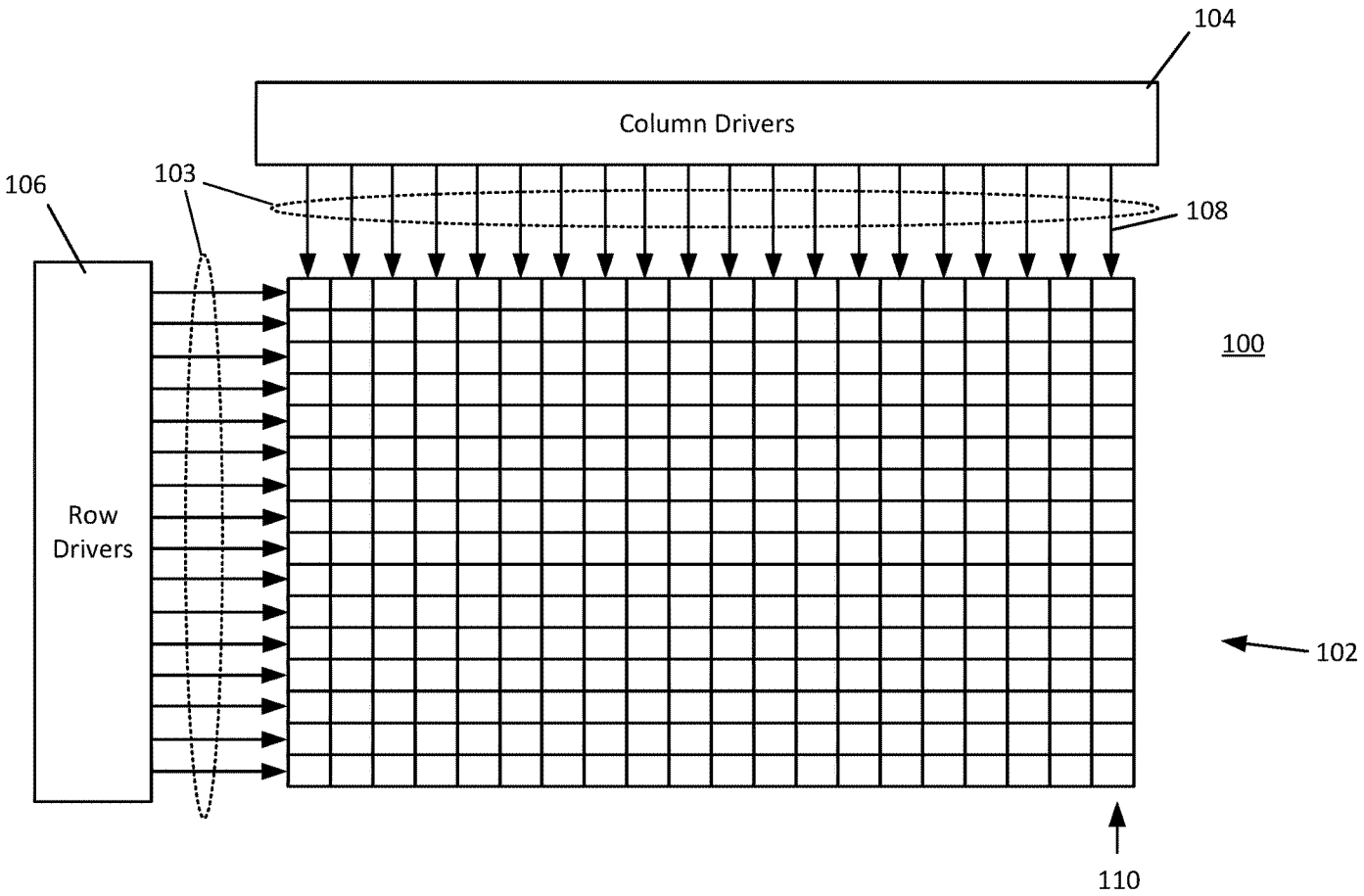
FIG. 1 illustrates a simple example of a micro-display according to the embodiments.

The micro-displays described herein generally include a pixel array 102 driven by a number of data and control signals 103, as shown in the simple example of FIG. 1. To make the following description easier to understand, this exemplary micro-display 100 includes 20 columns and 16 rows for a total of 320 pixels, although as described above, practical micro-displays typically have many more pixels (e.g., XGA with 1024 columns and 768 rows).

The micro-display includes column drivers 104 and row drivers 106 that together provide information to the pixel array 102. The column drivers 104 may provide image information to the pixels, and the row drivers 106 may provide control information to the pixels. A column driver signal 108 for a particular a particular pixel column 110 may include multiple signals.

In some embodiments, such as for a LCoS (Liquid Crystal on Silicon) or an OLED (Organic Light Emitting Diode) display device, the column drivers 104 shown in FIG. 1 may include a ramp Digital to Analog Converter (DAC) and amplifier, which produces a voltage ramp signal.

Figure 3:
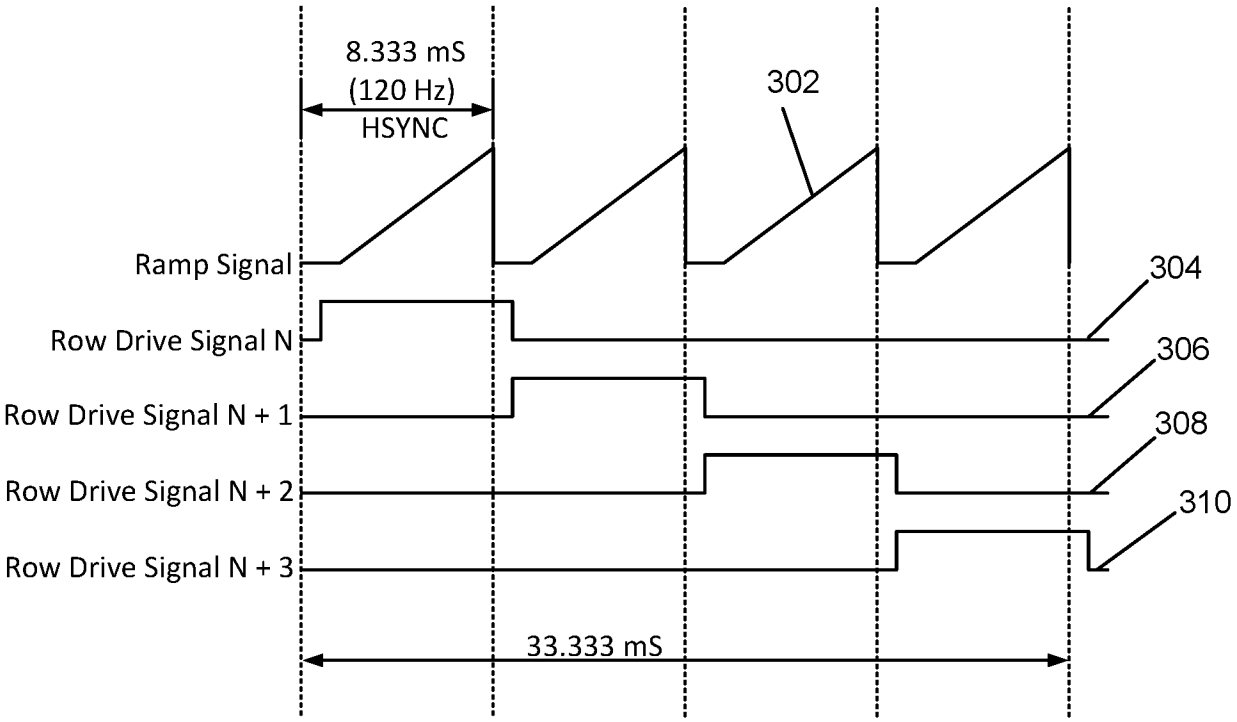
FIG. 3 shows an example timing diagram for signals that may be used to drive the pixel array shown in FIG. 2.

The voltage ramp signal may be a periodic signal that increases linearly from a first voltage to a second voltage then repeats (see, e.g., FIG. 3). The voltage ramp may be sampled at a particular time, and held to produce a desired fixed voltage output, for use by the associated column of pixels.

The DAC may be a device that receives a digital word (e.g., 8 bits, 16 bits 32 bits, etc.) that represents a binary value. The DAC produces a voltage output corresponding to the value of the digital word. A voltage ramp signal may be generated, for example, by causing the digital word to count sequentially from a low value to a high value (e.g., 00000000 to 11111111), and repeating the count periodically. For example, in one embodiment a counter programmed to count from an initial value to a terminal value, and then caused to rollover to the initial value and repeat, may be used to generate such a digital word sequence.

The amplifier may receive the voltage ramp signal from the DAC and produce a output signal that is an amplified version of the received voltage ramp signal. In other words, the amplifier output=g*(voltage ramp signal), where g is the gain of the amplifier. In some embodiments, the gain g of the amplifier is a positive real number greater than one, although in other embodiments the gain g may be between zero and one.

Figure 2:
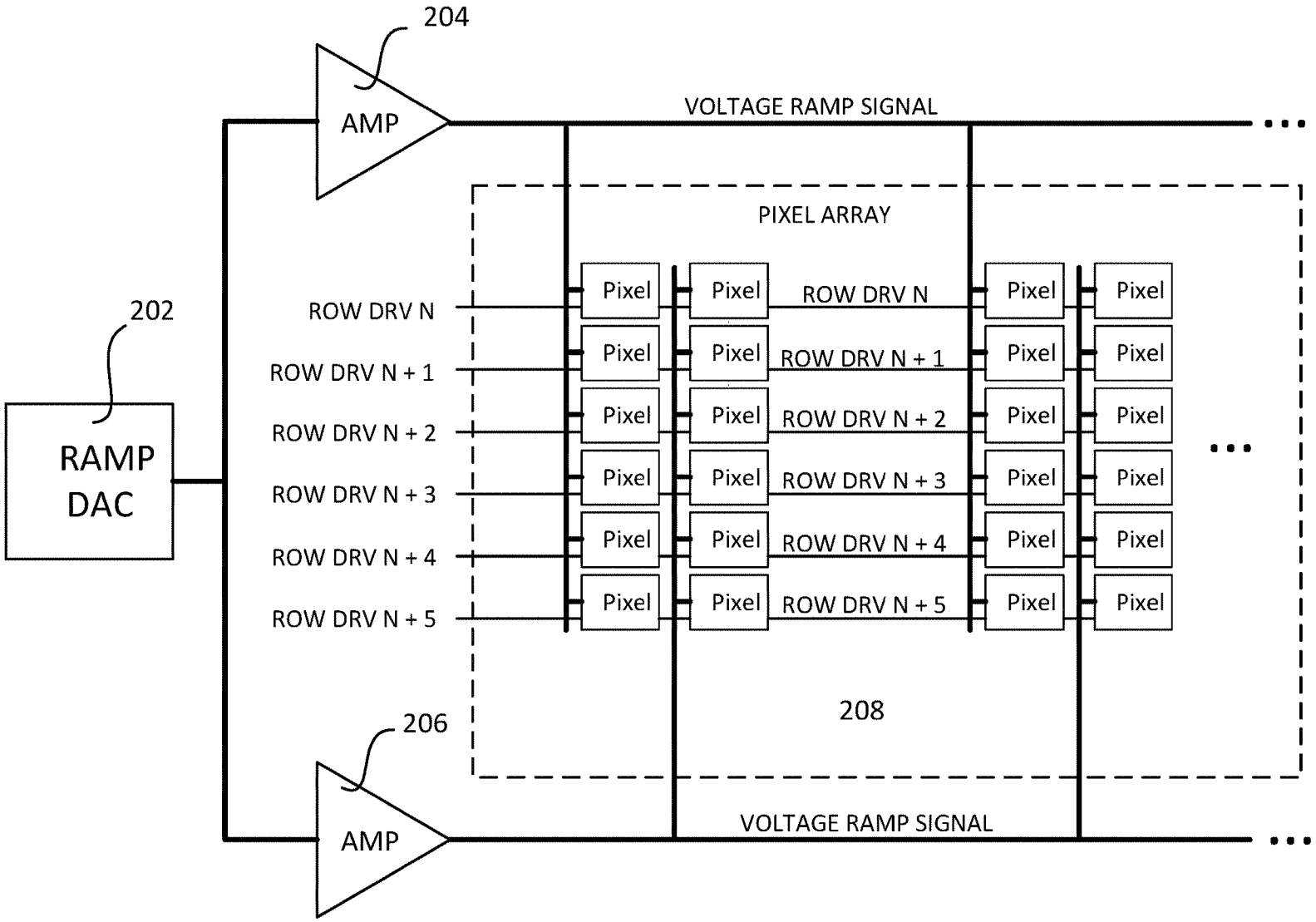
FIG. 2 illustrates one example of a ramp DAC arrangement.

FIG. 2 illustrates one example of a ramp DAC arrangement, including a single ramp DAC 202 that drives a first amplifier 204 and a second amplifier 206. In this embodiment, the amplifiers 204, 206 are arranged to drive a pixel array 208 from two portions of the array 208. The arrangement of pixels within the array 208, as depicted in FIG. 2, is intended to represent the physical arrangement (i.e., physical layout) of the pixels. In this example, the two delineating portions are the top and bottom of the pixel array, although other delineating arrangements may alternatively be used.

FIG. 3 shows an example timing diagram for signals that may be used to drive the pixel array 208 of FIG. 2. In this example, a 120 Hz HSYNC ramp signal 302 is generated by the RAMP DAC 202, and is relayed to the pixels in the pixel array 208 through amplifiers 204 and 206. Only one row is driven for each cycle of the ramp signal 302. In this example, the $N^{th}$ row driving signal 304 (i.e., Row Drive Signal N) is active during the first cycle depicted of the ramp signal 302, the $N+1^{st}$ row driving signal 306 (i.e., Row Drive Signal N+1) is active during the second cycle depicted of the ramp signal 302, the $N+2^{nd}$ row driving signal 308 (i.e., Row Drive Signal N+2) is active during the third cycle depicted of the ramp signal 302, and the $N+3^{rd}$ row driving signal 310 (i.e., Row Drive Signal N+3) is active during the fourth cycle depicted of the ramp signal 302. The period of the 120 Hz ramp signal is 1/120 seconds=8.333 mS, so it takes approximately 4×8.33 mS=33.33 mS to drive four pixel rows.

Figure 4:
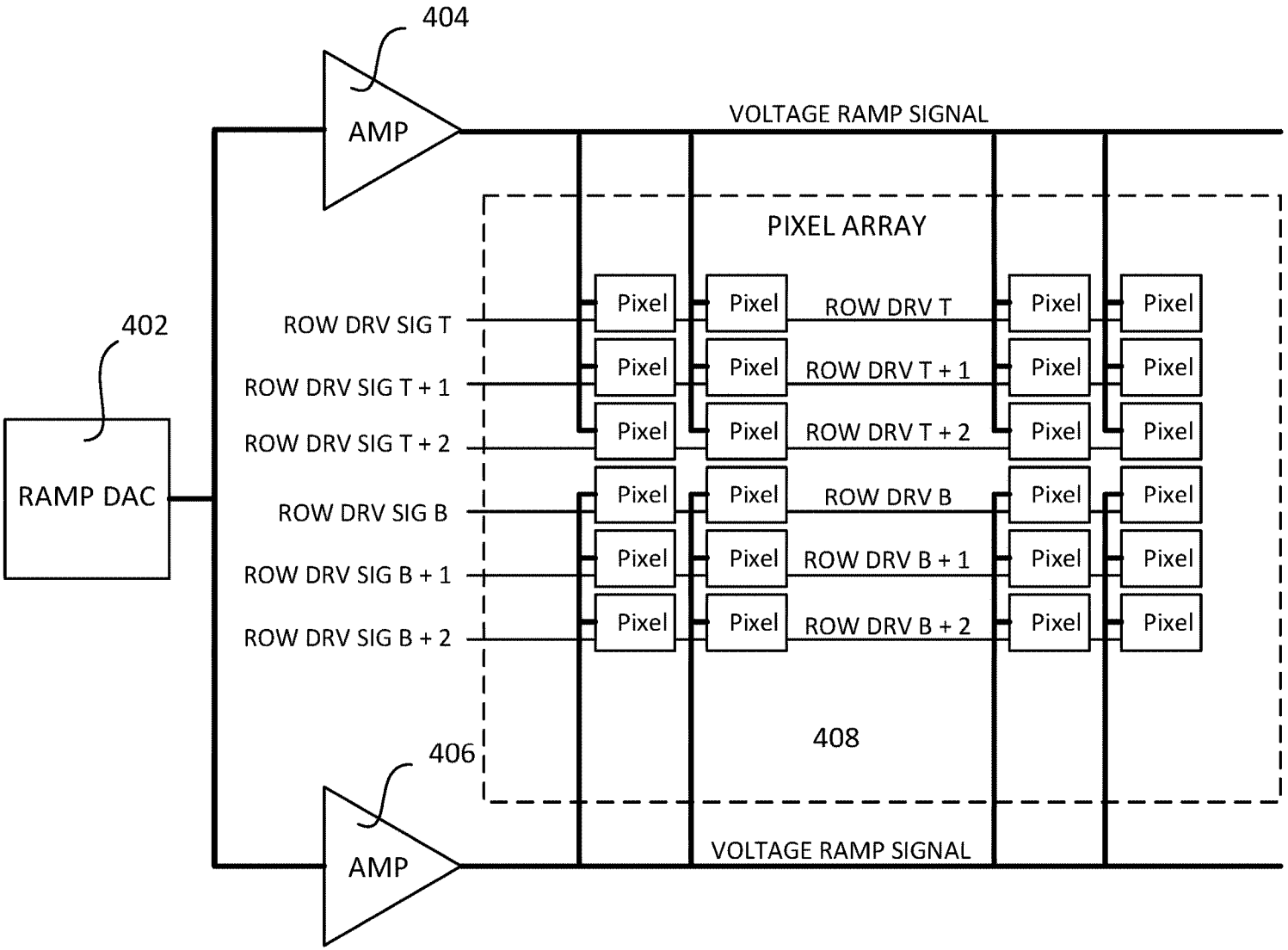
FIG. 4 shows another example of a ramp DAC arrangement, constructed according to the described embodiments.

FIG. 4 shows another example of a ramp DAC arrangement, constructed according to the described embodiments, including a single ramp DAC 402 that drives a first amplifier 404 and a second amplifier 406. In this embodiment, the amplifiers 404 and 406 are arranged to drive a pixel array 408 from two sides of the array 408, the top and bottom of the array 408 as with the example of FIG. 2. In the example of FIG. 4, however, each amplifier 404 and 406 drives a portion of each column (in this case, half of each column)—in other words, the amplifiers 404 and 406 share the driving of pixel columns. In other embodiments, the amplifiers may drive more or less than one half of the shared columns.

In the example embodiment of FIG. 4, the $T^{th}$ top row driving signal (i.e., ROW DRV SIG T) and the $B^{th}$ bottom row driving signal (i.e., ROW DRV SIG B) are active during the first ramp cycle, similar to the ramp signal 302 interaction with Row Drive Signal N 304, shown in FIG. 3. The $T+1^{st}$ top row driving signal (i.e., ROW DRV SIG T+1) and the $B+1^{st}$ bottom row driving signal (i.e., ROW DRV SIG B+1) are active during the second ramp cycle, similar to the ramp signal 302 interaction with Row Drive Signal N+1, shown in FIG. 3. The $T+2^{nd}$ top row driving signal (i.e., ROW DRV SIG T+2) and the $B+2^{nd}$ bottom row driving signal (i.e., ROW DRV SIG B+2) are active during the third ramp cycle, similar to the ramp signal 302 interaction with Row Drive Signal N+2, shown in FIG. 3.

Figure 5:
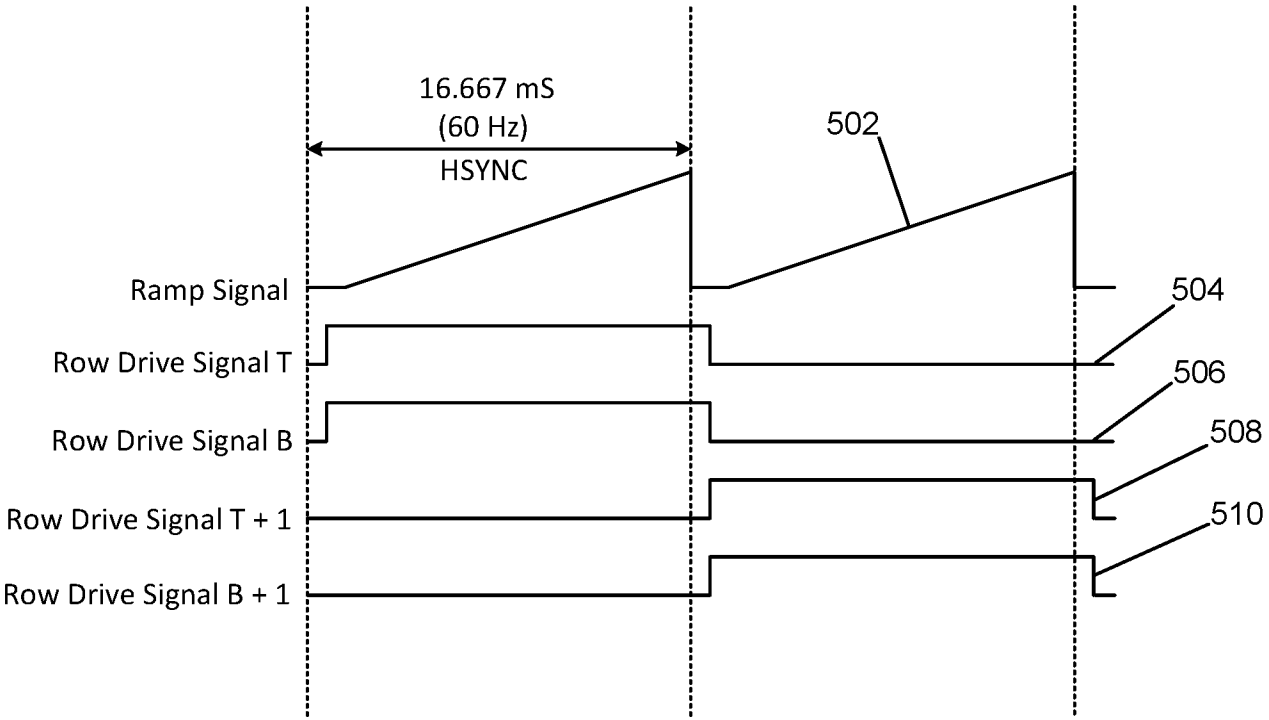
FIG. 5 illustrates an example timing diagram for signals that may be used to drive the pixel array shown in FIG. 4.

Because the configuration shown in FIG. 4 allows for driving two rows simultaneously (e.g., row T and row B, row T+1 and row B+1, etc.), the entire array can be driven while using less power, as compared to the array configuration shown in FIG. 2. FIG. 5 illustrates an example timing diagram for signals that may be used to drive the pixel array 408 of FIG. 4. In this example, a 60 Hz HSYNC ramp signal 502 is generated by the RAMP DAC 402, and is relayed to the pixels in the pixel array 408 through the amplifiers 404 and 406. As the timing diagram of FIG. 5 shows, the ramp signal 502 may be half the frequency (i.e., 60 Hz) of the ramp signal 302 of FIG. 2 and FIG. 3, because two rows are driven for each cycle of the ramp signal 502. During the first cycle depicted of the ramp signal 502, the row driving signals 504 and 506 for rows T and B, respectively, are active. During the second cycle depicted of the ramp signal 502, the row driving signals 508 and 510 for rows T+1 and B+1, respectively, are active.

The period of the 60 Hz ramp signal is 1/60 seconds=16.66 mS, but since two rows are driven for each cycle of the ramp signal 502, it takes approximately 2×16.66 mS=33.33 mS to drive four rows. The arrangement shown in FIGS. 4 and 5 therefore drives four rows in the same amount of time as the arrangement shown in FIGS. 2 and 3 drives the same four rows. But since the arrangement of FIG. 4 and FIG. 5 uses a ramp signal 502 that is half the frequency of the ramp signal 302 used in the arrangement shown in FIGS. 2 and 3, the arrangement of FIGS. 4 and 5 requires less power.

Figure 6:
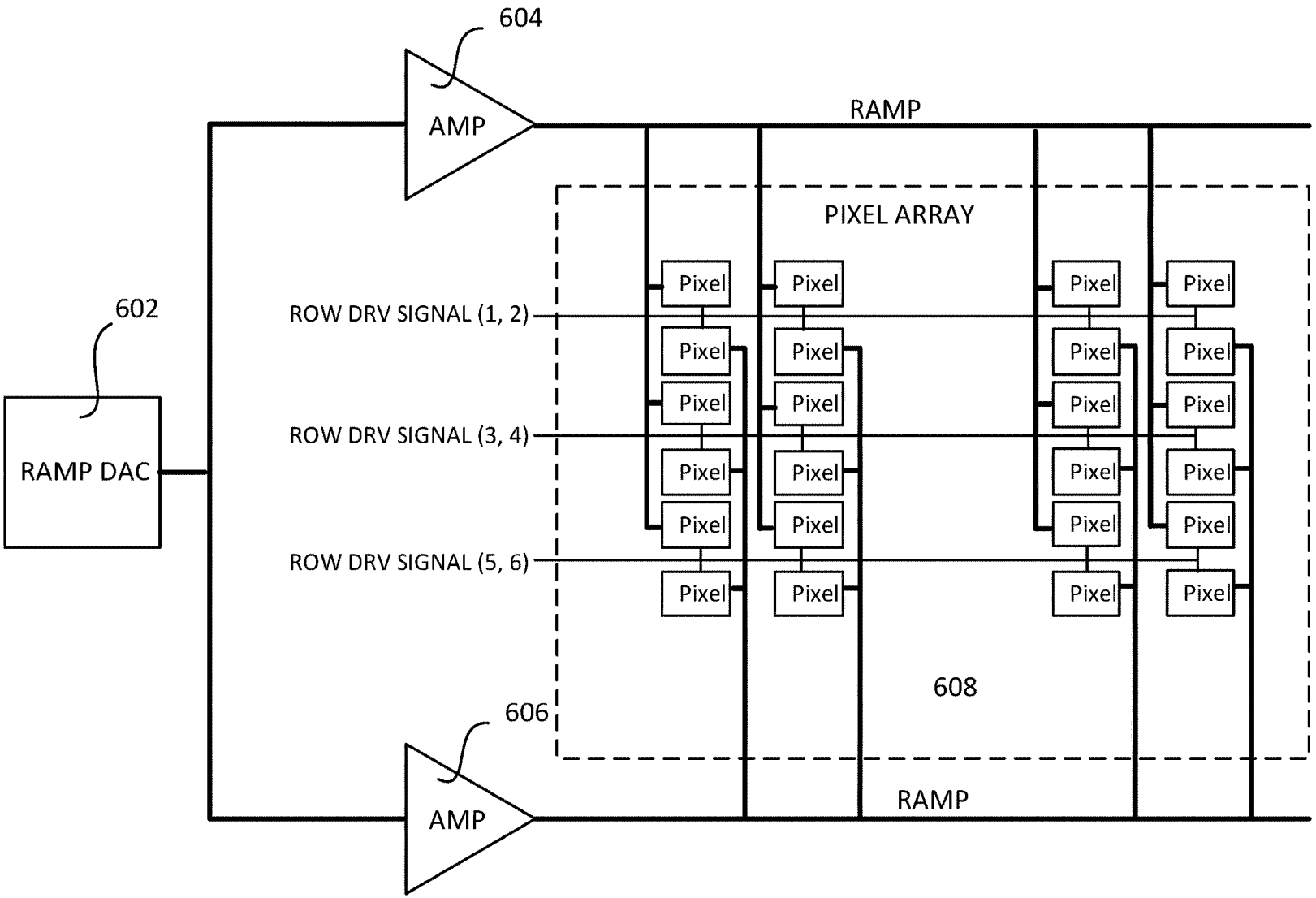
FIG. 6 shows yet another example of a ramp DAC arrangement, constructed according to the described embodiments.
Figure 7:
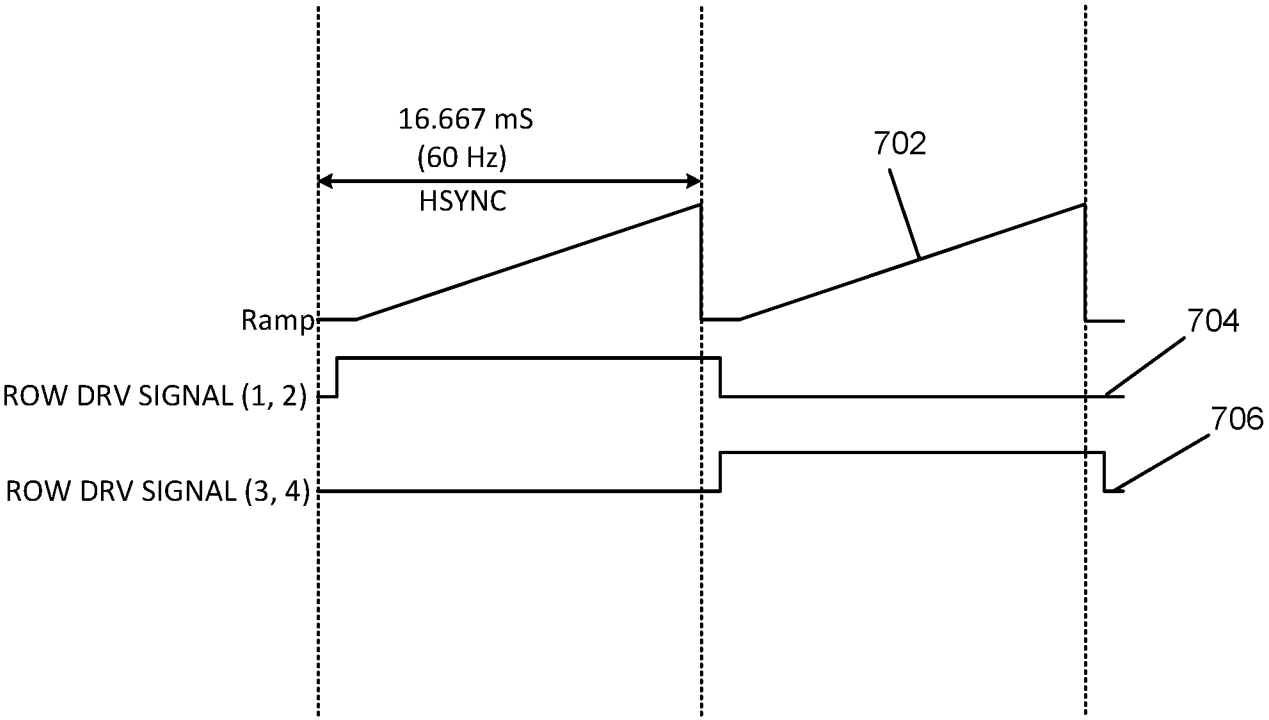
FIG. 7 illustrates an example timing diagram for signals that may be used to drive the pixel array shown in FIG. 6.

FIG. 6 shows yet another example of a ramp DAC arrangement, constructed according to the described embodiments, including a single ramp DAC 602 that drives a first amplifier 604 and a second amplifier 606. In this embodiment, the amplifiers 604, 606 are arranged to drive a pixel array 608 from two sides of the array 408, the top and bottom of the array as with the example of FIG. 2. In the example of FIG. 6, however, amplifier 604 drives odd rows (e.g., rows 1, 3, 5, etc.) while amplifier 606 drives even rows (e.g., rows 2, 4, 6, etc.). The timing diagram shown in FIG. 7 applies to the arrangement shown in FIG. 6, and is similar to the timing diagram shown in FIG. 5.

The arrangement shown in FIG. 6 provides a number of advantages. Pixels can be accepted in standard scan order, with only one line buffer of memory required. FIG. 4 requires one half frame buffer, adding latency which is highly undesirable for VR (virtual reality) applications. The arrangement of FIG. 6 relaxes the constraint on matching amplifiers 604 and 606, since mismatch of even and odd rows will be much less perceptible than mismatch between top and bottom image halves. The FIG. 6 arrangement reduces motion artifacts, as all rows are scanned at nearly the same time as their neighbors. By contrast, in the FIG. 4 arrangement, row T+2 is scanned long after row B. The arrangement of FIG. 6 shares row lines between adjacent rows, so only one half pitch is required per row.

It should be noted that the arrangement of FIG. 6 requires two column line pitches per column, and the necessarily longer column lines will have somewhat higher capacitances, although the number of pixels per column line remains the same as compared to the architecture shown in FIG. 4.

The example embodiments herein demonstrate the disclosed subject matter by doubling the number of rows driven while halving the ramp frequency. It should be understood that other variations (i.e., other than doubled and halved) of ramp frequency and number of pixel rows may be used to reduce power while maintaining the number of pixels driven per unit time, according to the underlying concepts of the described embodiments.

It will be apparent that one or more embodiments, described herein, may be implemented in many different forms of software and hardware. Software code and/or specialized hardware used to implement embodiments described herein is not limiting of the invention. Thus, the operation and behavior of embodiments were described without reference to the specific software code and/or specialized hardware—it being understood that one would be able to design software and/or hardware to implement the embodiments based on the description herein.

Further, certain embodiments of the invention may be implemented as logic that performs one or more functions. This logic may be hardware-based, software-based, or a combination of hardware-based and software-based. Some or all of the logic may be stored on one or more tangible computer-readable storage media and may include computer-executable instructions that may be executed by a controller or processor. The computer-executable instructions may include instructions that implement one or more embodiments of the invention. The tangible computer-readable storage media may be volatile or non-volatile and may include, for example, flash memories, dynamic memories, removable disks, and non-removable disks.

While this invention has been particularly shown and described with references to example embodiments thereof, it will be understood by those skilled in the art that various changes in form and details may be made therein without departing from the scope of the invention encompassed by the appended claims.

What is claimed is:

1. A method of driving a pixel array, comprising:

providing a ramp signal;

amplifying the ramp signal with a first amplifier to produce a first amplified ramp signal;

amplifying the ramp signal with a second amplifier to produce a second amplified ramp signal;

simultaneously driving at least two rows of a first set of pixels of the pixel array with the first amplified ramp signal, during a first cycle of the ramp signal; and simultaneously driving at least two rows of a second set of pixels of the pixel array with the second amplified ramp signal, during a second cycle of the ramp signal.

2. The method of claim 1, further including providing a first amplifier and a second amplifier, each of the first and second amplifiers receiving an input ramp signal from a digital-to-analog converter and producing a first amplified ramp signal and a second amplified ramp signal, respectively.

3. The method of claim 2, wherein the first amplifier and the second amplifier are unity gain amplifiers.

4. The method of claim 2, further including coupling an output of the first amplifier to a first set of pixels of a pixel array and coupling an output of the second amplifier to a second set of pixels of the pixel array, the first set of pixels of the pixel array being a first set of pixel columns, the second set of pixels of the pixel array being a second set of pixel columns, the first set of pixel columns and the second set of pixel columns being spatially arranged on the pixel array such that columns of the first set of pixel columns alternate with columns of the second set of pixel columns.

5. The method of claim 4, further including providing the first amplified ramp signal to the first set of pixels of the pixel array and providing the second amplified ramp signal to the second set of pixels of the pixel array.

6. The method of claim 2, further including coupling an output of the first amplifier to a first set of pixels of a pixel array and coupling an output of the second amplifier to a second set of pixels of the pixel array, the first set of pixels of the pixel array being a first set of pixel rows of N rows, the second set of pixels of the pixel array being a second set of pixel rows of N rows, the first set of pixel rows including pixels of rows 1 through M, and the second set of pixels including pixels of rows M+1 through N, where M and N are integers.

7. The method of claim 6, further including providing the first amplified ramp signal to the first set of pixel rows, and providing the second amplified ramp signal to the second set of pixel rows.

8. The method of claim 2, further including coupling an output of the first amplifier to a first set of pixels of a pixel array and coupling an output of the second amplifier to a second set of pixels of the pixel array, the first set of pixels of the pixel array being a first set of pixel rows, the second set of pixels of the pixel array being a second set of pixel rows, the first set of pixel rows and the second set of pixel rows being spatially arranged on the pixel array such that rows of the first set of pixel rows alternate with rows of the second set of pixel rows.

9. The method of claim 1, further including providing a digital-to-analog converter configured to generate the ramp signal.

10. A pixel array driver, comprising:

a ramp signal generator configured to produce a ramp signal;

a first amplifier configured to receive the ramp signal and produce a first amplified ramp signal;

a second amplifier configured to receive the ramp signal and produce a second amplified ramp signal;

the first amplified ramp signal being electrically connected to a top half of a column of pixels of a pixel array, and the second amplified ramp signal being electrically connected to a bottom half of a column of pixels of the pixel array.

11. The pixel array driver of claim 10, wherein the first set of pixels of the pixel array is a first set of pixel columns and the second set pixels of the pixel array is a second set of pixel columns, the first set of pixel columns and the second set of pixel columns being spatially arranged on the pixel array such that columns of the first set of pixel columns alternate with columns of the second set of pixel columns.

12. The pixel array driver of claim 11, wherein the first set of pixel columns includes the $N^{th}$ pixel columns, and the second set of pixel columns includes the $(N+1)^{th}$ pixel columns, where N designates two or more consecutive even integers, beginning with N=2.

13. The pixel array driver of claim 11, wherein the first set of pixel columns receives the first amplified ramp signal, and the second set of pixel columns receives the second amplified ramp signal.

14. The pixel array driver of claim 10, wherein the first set of pixels and the second set of pixels of the pixel array are arranged in N rows, the first set of pixels includes pixels of rows 1 through M, and the second set of pixels includes pixels of rows M+1 through N, where M and N are integers.

15. The pixel array driver of claim 14, wherein the pixels of rows 1 through M receive the first amplified ramp signal, and the pixels of rows M+1 through N receive the second amplified ramp signal.

16. The pixel array driver of claim 10, wherein the first set of pixels of the pixel array is a first set of pixel rows and the second set pixels of the pixel array is a second set of pixel rows, the first set of pixel rows and the second set of pixel rows being spatially arranged on the pixel array such that rows of the first set of pixel rows alternate with rows of the second set of pixel rows.

17. The pixel array driver of claim 16, wherein the pixels of the first set of pixel rows receives the first amplified ramp signal, and the pixels of the second set of pixel rows receives the second amplified ramp signal.

18. The pixel array driver of claim 10, wherein the ramp signal generator includes a digital-to-analog converter.

19. The pixel array driver of claim 18, further including a counter configured to generate a digital word and provide the digital word to the digital-to-analog converter, wherein the digital word counts from an initial value to a terminal value, rolls over to the initial value, and repeats the count from the initial value.

20. The pixel array driver of claim 10, wherein the first and second amplifiers are unity gain amplifiers.

* * * * *